US005708930A

United States Patent [19]

Nagase et al.

[11] Patent Number: 5,708,930

[45] Date of Patent: Jan. 13, 1998

[54] COLOR IMAGE FORMING APPARATUS HAVING A TRANSPARENT IMAGE FORMING BODY

[75] Inventors: Hisayoshi Nagase; Shuta Hamada; Satoshi Haneda; Hiroyuki Tokimatsu, all of Tokyo, Japan

[73] Assignee: Konica Corporation, Tokyo, Japan

[21] Appl. No.: 587,220

[22] Filed: Jan. 16, 1996

[30] Foreign Application Priority Data

Jan. 19, 1995 [JP] Japan ..... 7-006450
Jan. 31, 1995 [JP] Japan ..... 7-013983

[51] Int. Cl.[6] ..... G03G 15/00

[52] U.S. Cl. ..... 399/159; 399/223

[58] Field of Search ..... 355/200, 210, 355/211, 219, 228, 229, 326 R, 327; 399/130, 159, 177, 178, 222, 223, 231, 298

[56] References Cited

U.S. PATENT DOCUMENTS 4,803,514 2/1989 Hiratsuka et al. .
4,952,978 8/1990 Ueda et al. .
4,961,094 10/1990 Yamaoki et al. .
5,053,821 10/1991 Kunugi et al. .
5,172,163 12/1992 Yamaoki et al. .
5,216,466 6/1993 Mitani .
5,272,508 12/1993 Sakakibara et al. .
5,523,825 6/1996 Satoh et al. .

FOREIGN PATENT DOCUMENTS 0 140 011 5/1985 European Pat. Off. .
0 671 667 9/1995 European Pat. Off. .

*Primary Examiner*—Sandra L. Brase
*Attorney, Agent, or Firm*—Frishauf, Holtz, Goodman, Langer & Chick, P.C.

[57] ABSTRACT

An image forming apparatus such as a copier or a printer for forming a color image. The image forming apparatus includes: a transparent photoreceptor drum for retaining a multi-color toner image in which the wall-thickness and an inner diameter of the drum are respectively between 2.5 mm and 8 mm and between 60 mm and 200 mm; plural chargers, provided on the periphery of the photoreceptor drum, for charging the drum surface; plural imagewise exposure systems, provided inside of the photoreceptor drum, for forming latent images on the drum surface; and plural developers, provided on the periphery of the photoreceptor drum, for developing the latent images with different color toners so as to form a superimposed multi-color toner image on the drum surface while the photoreceptor drum is being rotated one time.

12 Claims, 7 Drawing Sheets

COLOR IMAGE FORMING APPARATUS HAVING A TRANSPARENT IMAGE FORMING BODY

BACKGROUND OF THE INVENTION

The present invention relates to a color image forming apparatus of an electrophotographic system wherein a plurality of charging means, imagewise exposure means and developing means are arranged around the circumferential surface of a drum-shaped image forming body, and toner images are superposed on the image forming body while it makes one turn to form a color toner image.

As a method for forming a multi-color image, there are known apparatus (A) wherein photoreceptors, charging units and developing units respectively in quantity identical to the number of necessary colors for an image are provided and a respective toner image of a single color formed on each photoreceptor is superposed on an intermediate transfer object to form a color image, apparatus (B) wherein a single photoreceptor makes plural turns to repeat a cycle of charging, imagewise exposure and developing for each color for forming a color image, and apparatus (C) wherein a color image is formed during one turn of a single photoreceptor in which charging, imagewise exposure and developing for each color are conducted.

However, the aforementioned apparatus (A) has a disadvantage that a volume of the apparatus is inevitably large because a plurality of photoreceptors and intermediate transfer objects are required, and the apparatus (B), on the other hand, has a disadvantage that a size of an image formed is limited to the surface area of a photoreceptor or less, though a volume of the apparatus can be made small because only one is required for each of the charging means, imagewise exposure means and photoreceptor.

The aforementioned color image forming apparatus (C) is characterized in that a size of an image is not limited and image forming can be carried out in a short period of time. However, there is a limitation in making an image forming body small, namely, in making an apparatus small, because plural sets of the charging means, imagewise exposure means and developing means are required to be arranged around an image forming body. On the other hand, there is proposed an apparatus wherein a transparent member is used for the substrate of an image forming body, and an imagewise exposure means is housed in the image forming body to make it small by conducting imagewise exposure from the inside.

In this case, however, due to an arrangement that the substrate of the image forming body is located to interfere the optical path for imagewise exposure, fluctuation in registration between superposed images is caused or out of focus is caused, being influenced by thermal expansion caused by a rise in environmental temperature and by heat generation of a light source for imagewise exposure, or by a strain and uneven rotation caused by pressure contact between a developing means and a cleaning means, resulting in doubling which causes lowered image quality, which is a problem.

SUMMARY OF THE INVENTION

The first object of the invention is to provide a color image forming apparatus capable of forming at high speed a color image with high image quality, by realizing a transparent image forming body having sufficient strength against external force and is resistant to temperature change, after solving the problem mentioned above for improvement.

The above-mentioned first object is attained by a color image forming apparatus having therein plural charging means for charging, imagewise exposure means for forming latent images and developing means for visualizing the latent images all arranged around the circumferential surface of a rotary drum-shaped image forming body so that a cycle of charging, imagewise exposure and developing is repeated during one turn of the image forming body to form superposed toner images which are transferred onto a transfer material, in which a light-sensitive layer is provided on the external circumferential surface of the transparent substrate of the image forming body and imagewise exposure is conducted from the inside of the image forming body, and the transparent substrate mentioned above has a wall-thickness between 3 mm–8 mm and an inside diameter between 60 mm–200 mm.

In the invention, as a cylindrical and transparent member forming a substrate of an image forming body, an optical glass is used preferably from the viewpoint of transparency, or a transparent acrylic resin is preferably used from the viewpoint of moldability.

The wall-thickness of the transparent substrate is restricted, depending on the length of an optical path on the image forming side of an optics system in an imagewise exposure means housed in the transparent substrate, to the thickness which can be included in terms of dimension. In the case where an LED is used as a light source and a SELFOC lens is used for image forming, for example, an image is formed at a position 3–10 mm ahead of the lens, which also restricts the thickness of the transparent substrate accordingly. It is also required that an inside diameter of the image forming body is at least the size sufficient to house each imagewise exposure means or larger, and it also is a size within a range which can keep the mechanical strength causing neither strain nor deformation when external force is applied by a developing means or the like. From the viewpoint of reducing uneven rotation of the image forming body, it is preferable that moment of inertia is great, which, however, increases a load for the driving system and causes a problem.

With regard to an image forming body having such many restrictions, inventors of the invention prepared many transparent substrates having different wall-thicknesses and inside diameters, assembled them in a color image forming apparatus, formed color images practically, and judged them to confirm that a thickness and an inside diameter of a substrate of an image forming body satisfying the aforementioned conditions are respectively in a diameter range of 3–8 mm and a range of 60–200 mm.

Further, the second object of the invention is to develop a manufacturing method for a cylindrical substrate which can be manufactured efficiently on an industrial basis and has high surface accuracy and high overall strength, while being transparent sufficiently when necessary, and to manufacture a static image forming apparatus employing the cylindrical substrate as an image forming body.

The second object of the invention can be attained by employing either one of the following structures.

(1) An image forming body used in an image forming apparatus characterized in that polymerizing liquid material was poured in a cylindrical mold to be polymerized while being rotated and heated.

(2) The image forming body used in an image forming apparatus described in above Item (1), wherein polymerization was conducted while giving rotation and heat in the presence of a catalyzer.

(3) The image forming body used in an image forming apparatus described in above Item (1) characterized in that at least either one of a cross-linking agent, a conductivity-donating agent and a coloring agent is contained therein.

(4) The image forming body used in an image forming apparatus described in above Items (1), (2) or (3) characterized in that an organic photoconductive layer was formed on the substrate by coating.

(5) The image forming body used in an image forming apparatus described in either one among above Items (1)–(5) characterized in that the cylindrical mold mentioned above is provided with a pressure-injection flange portion or a gear portion.

BRIEF DESCRIPTION OF THE DRAWINGS

FIG. 6(*b*) is a sectional view of an example of a mold.

DETAILED DESCRIPTION OF THE INVENTION

Figure 1:
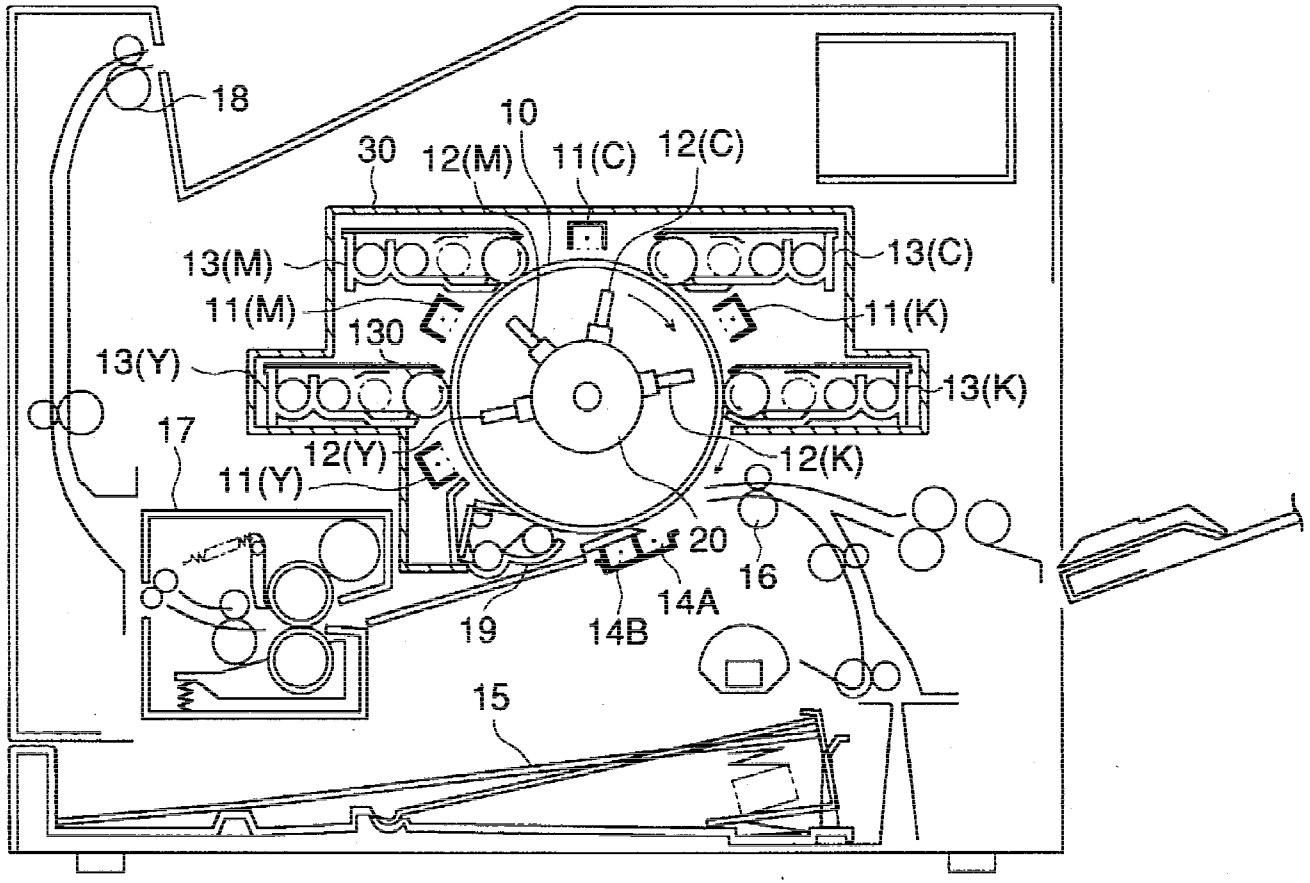
FIG. 1 is a sectional view showing how a color image forming apparatus of the first example in the invention is structured.

The first example of the invention will be explained as follows, referring to FIGS. 1–5.

The numeral 10 is a drum-shaped image forming body, namely, a photoreceptor drum wherein an organic photoconductive layer (OPC) composed of a transparent conductive layer is coated on the outer circumferential surface of a substrate formed with a transparent member such as optical glass or transparent acrylic resins, and it is rotated clockwise while it is grounded.

The numeral 11 is a scorotron charger which is a charging means, and it conducts charging operations through corona discharging between a grid held at a predetermined voltage against the aforementioned organic photoconductive layer of photoreceptor drum 10 and a discharge wire, and thereby applies uniform voltage on the photoreceptor drum 10.

The numeral 12 is a an exposure optical system which is an imagewise exposure means, and it is composed of light-emitting elements such as LED, FL, EL and PL arranged in the axial direction of photoreceptor drum 10 and a SELFOC lens. Image signals for each color read by a separate image reading unit are taken out of a memory in succession and are inputted in the aforesaid exposure optical system 12 as electrical signals. A light-emission wavelength of each light-emitting element used in the present example is the same as others and it is within a range of 500–900 nm.

Figure 4:
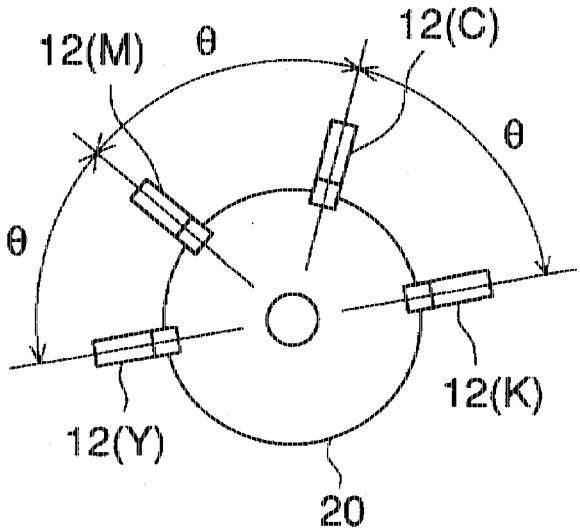
FIG. 4 is an illustration showing an layout of an exposure optical system.

Each exposure optical system 12 mentioned above is affixed on a common and column-shaped supporting member 20, and exposure optical systems 12 (Y), 12 (M), 12 (C) and 12 (K) are arranged at regular intervals as shown in FIG. 4 to be housed in the substrate of the aforesaid photoreceptor drum 10. In place of the aforementioned light-emitting elements, the exposure optical system may also be composed of a combination of light-shutter members such as LCD, LISA and PLZT and an image-forming lens such as a SELFOC lens.

Symbols 13Y, 13M, 13C and 13K are developing units which are developing means which respectively contain yellow (Y), magenta (M), cyan (C) and black (K) developing agents, and each of them is provided with developing sleeve 130 which rotates in the same direction as that of a circumferential surface of photoreceptor drum 10 while keeping a prescribed distance from it.

Each developing unit 13 mentioned above performs reversal development on a non-contact basis through impression of developing bias voltage for an electrostatic latent image formed on photoreceptor drum 10 through the charging by means of the charger 11 and imagewise exposure by means of the exposure optical system 12.

Next, processes of a color image forming apparatus in the present apparatus will be explained.

With regard to images on an original, images read by an image-pickup element, or images compiled by a computer are stored temporarily in a memory as an image signal for each of Y, M, C and K colors.

Upon the start of image recording, a photoreceptor-driving motor rotates to rotate photoreceptor drum 10 clockwise, and simultaneously with this, charger 11 (Y) starts charging to give a voltage to photoreceptor drum 10.

After a voltage is given to the photoreceptor drum 10, imagewise exposure by means of electrical signals corresponding to the first color signals, namely, to image signals of yellow (Y) is started in the exposure optical system 12 (Y) mentioned above, and an electrostatic latent image corresponding to a yellow (Y) image among images on an original is formed on a photoconductive layer on the surface of the photoreceptor drum through drum rotation scanning.

The latent image mentioned above is subjected to reversal development conducted by developing unit 13 (Y) under the condition that developing agents on a developing sleeve are not in contact, and thereby a toner image of yellow (Y) is formed as the photoreceptor drum 10 rotates.

Then, on the photoreceptor drum 10, a voltage is further given on the aforesaid yellow (Y) toner image by charging operation of charger 11 (M), then, imagewise exposure is conducted by electrical signals corresponding to the second color signals of exposure optical system 12 (M), namely to image signals of magenta (M), and a toner image of magenta (M) is formed to be superposed on the yellow (Y) toner image through reversal development by developing unit 13 (M) on a non-contact basis.

In the same process, a toner image of cyan (C) corresponding to the third color signals is formed to be superposed in succession by charger 11 (C), exposure optical system 12 (C) and developing unit 13 (C), and finally, a toner image of cyan (K) corresponding to the fourth color signals is formed to be superposed in succession by charger 11 (K), exposure optical system 12 (K) and developing unit 13 (K), thus, a color toner image is formed, during one rotation of the photoreceptor drum 10, on a circumferential surface thereof.

The color toner image thus formed on a circumferential surface of the photoreceptor drum 10 is transferred, at transfer unit 14A, onto a transfer sheet which is a transfer material fed out of sheet-feed cassette 15 and transported in synchronization by timing roller 16.

The transfer sheet onto which a toner image has been transferred is neutralized in neutralizing unit 14B, thereby, separated from the drum surface, and is ejected on a tray located at the upper portion of an apparatus through sheet-ejection roller 18, after toner thereon is fused and fixed thereon in fixing unit 17.

On the other hand, the photoreceptor drum 10 from which a transfer sheet has been separated is cleaned by cleaning unit 19 to be free from residual toner, either to continue forming toner images of images on an original, or to stop temporarily to be standby for formation of images on another original.

Figure 2:
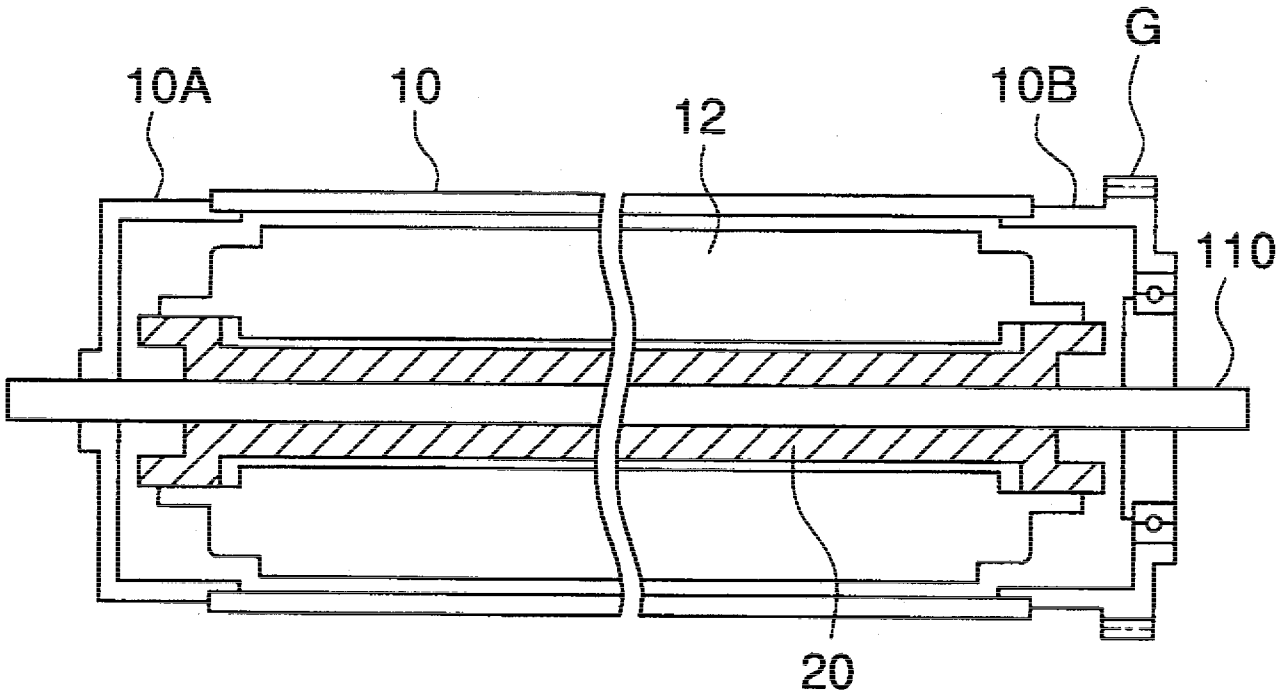
FIG. 2 is a longitudinal section showing how a photoreceptor drum is structured.

As shown in FIG. 2, the aforesaid photoreceptor drum 10 is supported rotatably around drum shaft 110 spanned and affixed on an apparatus main body with flange members 10A and 10B at both ends of the drum bearing-supported directly or indirectly on the drum shaft 110, and gear G united solidly with flange member 10B is engaged with a driving gear on the side of the apparatus main body to be driven so that the photoreceptor drum 10 may rotate in the prescribed direction at a constant speed.

The aforementioned drum shaft 110 passes through supporting member 20 on which the aforesaid exposure optical systems 12 are affixed, and it is united with the supporting member.

Each developing unit 13 mentioned above is urged elastically against the circumferential surface of the photoreceptor drum 10 in the horizontal direction, and a distance between developing sleeve 130 and a circumferential surface of the drum, namely the developing distance is kept to a prescribed distance with rotary stopper rollers (not shown) provided on both ends of each developing sleeve 130 which are in pressure contact with non-image areas on the circumferential surface of the drum.

The cleaning unit 19 mentioned above makes its cleaning blade to be in pressure contact constantly with the circumferential surface of the photoreceptor drum 10 and thereby removes residual toner left from the toner image whose transfer has been finished for cleaning.

Therefore, even in the course of imagewise exposure, external force caused by pressure contact of the developing unit 13 and the cleaning unit 19 is applied on the photoreceptor drum 10 which is also affected by temperature rise caused by heat generated by a light source of each exposure optical system 12.

Figure 3:
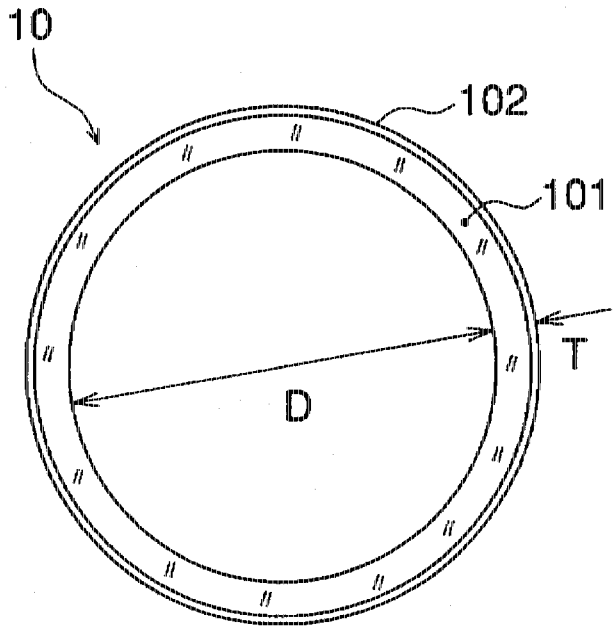
FIG. 3 is a cross sectional view of a main portion of the photoreceptor drum.

The photoreceptor drum 10 is composed of transparent drum substrate 101 made of optical glass having a thickness of T or transparent acrylic resin and thin and organic photoconductive layer 102 coated to be of a 10–50 μm thickness on the external circumferential surface of the drum substrate 101 as shown on a cross-sectional view in FIG. 3, and roundness and straightness of the photoconductive layer 102 are maintained by the mechanical strength of the drum substrate 101. Further, the transparency of the drum substrate is not necessary be colorless. The drum substrate may be slightly colored if the process of forming a latent image on the photoconductive layer thereof by the optical system is possible.

From the viewpoint of a depth of focus and brightness, the exposure optical system 12 employs a SELFOC lens having a length of an optical path of 3 mm–10 mm on its image-forming side. Therefore, the upper limit of thickness (T) of the drum substrate 101 is selected from a range of 2.5 mm–8 mm to be used preferentially, so that the drum substrate 101 can be put within the optical path length.

With regard to inside diameter (D) of the drum substrate 101, the minimum diameter of 60 mm which is marginal to contain exposure optical systems 12 united solidly with the drum shaft 110 and supporting member 20 is made to be a general lower limit, and the upper limit, on the other hand, is established by obtaining experimentally the maximum inside diameter (D) capable of assuring the mechanical strength as photoreceptor drum 10 together with thickness (T) selected in advance.

Figure 5:
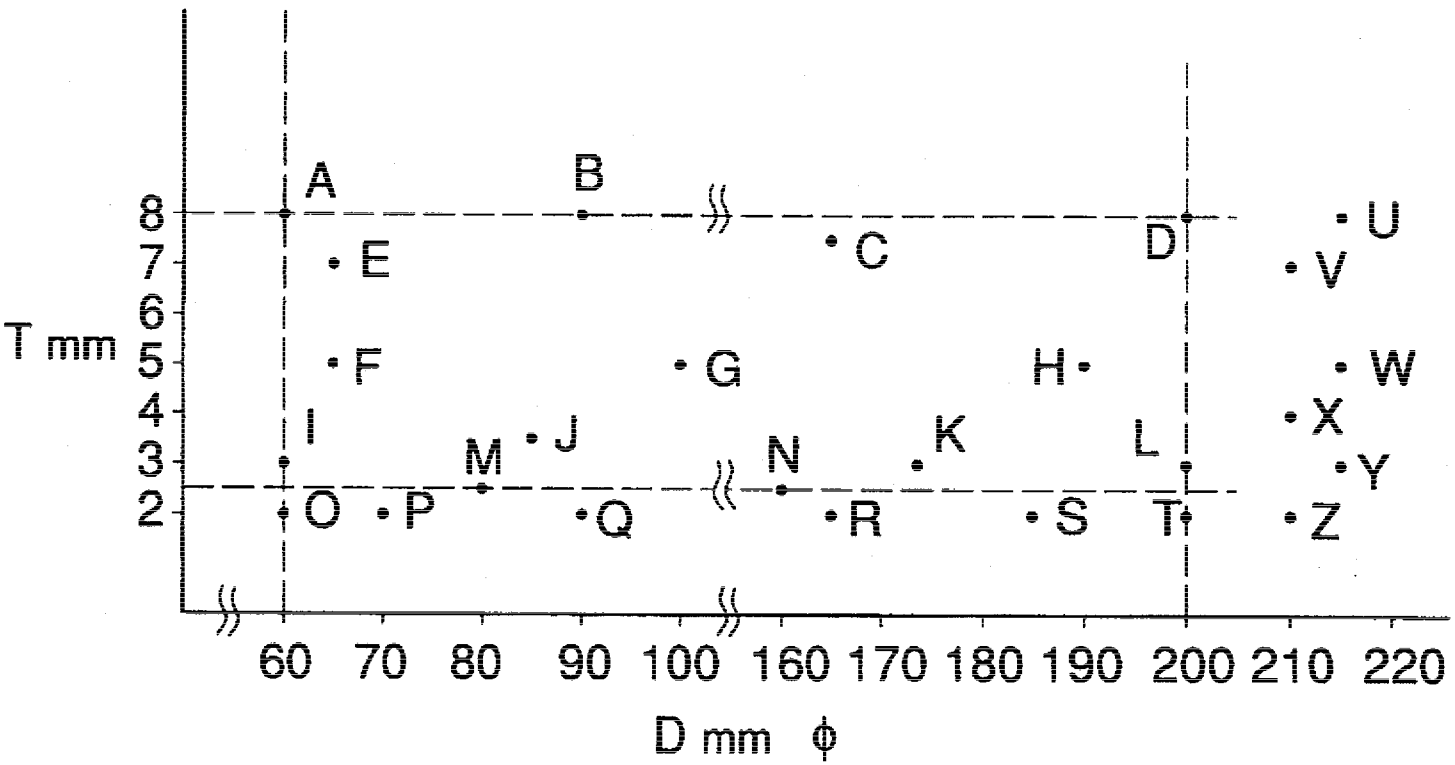
FIG. 5 is a graph showing distribution of thicknesses and inside diameters of a substrate of the photoreceptor drum.

In the experiments, photoreceptor drums 10 of various types and various sizes are prepared by using plural drum substrates 101 some are made of optical glasses (shown with symbol G) and others are made of transparent acrylic resins (shown with symbol P) varying in terms of combination of thickness (T) and inside diameter (D) as shown in FIG. 1 and a graph of FIG. 5, then, the photoreceptor drums are mounted practically in an image forming apparatus for image formation, and image quality of images obtained from that image formation is evaluated to determine the upper limit value of inside diameter (D) of drum substrate 101 which is not affected by strain and deformation caused by external force.

The results of the experiments are shown in Table 1 in which when thickness (T) is selected from a range from 2.5 mm, or preferably 3 mm, to 8 mm, evaluation is excellent (A) even when the upper limit value of inside diameter (D) is 200 mm as shown in the present example items A through N, while when thickness (T) is not more than 2 mm, the evaluation is slightly poor (B) when the lower limit value of inside diameter (D) is made to be less than 60 mm as shown in comparative example items O through Z, and when the upper limit value of inside diameter (D) is made to be greater than 200 mm, the evaluation is ranked to be extremely poor (C) even when thickness (T) is selected from a range of 2.5 mm–8 mm. Therefore, it has been cleared that it is preferable to determine the values of thickness (T) and inside diameter (D) of drum substrate 101 from an area enclosed with dotted lines in the graph in FIG. 5.

TABLE 1

| | | Drum substrate thickness (T) | Drum substrate inside diameter (D) | Material | Evaluation |
|---|---|---|---|---|---|
| Present Examples | A | 8 | 60 | G | A |
| | | | | P | A |
| | B | 8 | 90 | G | A |
| | | | | P | A |
| | C | 7.5 | 165 | G | A |
| | | | | P | A |
| | D | 8 | 200 | G | A |
| | | | | P | A |
| | E | 7 | 65 | G | A |
| | | | | P | A |
| | F | 5 | 65 | G | A |
| | | | | P | A |
| | G | 5 | 100 | G | A |
| | | | | P | A |
| | H | 5 | 190 | G | A |
| | | | | P | A |
| | I | 3 | 60 | G | A |
| | | | | P | A |
| | J | 3.5 | 85 | G | A |
| | | | | P | A |
| | K | 3 | 170 | G | A |
| | | | | P | A |
| | L | 3 | 200 | G | A |
| | | | | P | A |
| | M | 2.5 | 80 | G | A |

TABLE 1-continued

| | | Drum substrate thickness (T) | Drum substrate inside diameter (D) | Material | Evaluation |
|---|---|---|---|---|---|
| | | | | P | A |
| | N | 2.5 | 160 | G | A |
| | | | | P | A |
| | O | 2 | 60 | G | B |
| | | | | P | B |
| | P | 2 | 70 | G | B |
| | | | | P | B |
| | Q | 2 | 90 | G | B |
| | | | | P | C |
| | R | 2 | 165 | G | B |
| | | | | P | C |
| | S | 2 | 185 | G | C |
| | | | | P | C |
| Comparative Examples | T | 2 | 200 | G | C |
| | | | | P | C |
| | U | 8 | 215 | G | B |
| | | | | P | B |
| | V | 7 | 210 | G | B |
| | | | | P | B |
| | W | 5.5 | 215 | G | B |
| | | | | P | B |
| | X | 4 | 210 | G | B |
| | | | | P | B |
| | Y | 3 | 215 | G | C |
| | | | | P | C |
| | Z | 2 | 210 | G | C |
| | | | | P | C |

In the photoreceptor drum 10 whose mechanical strength against the external force is assured, exposure optical systems 12 to be contained in the drum are arranged on the common supporting member 20 so that all central angles θ can be the same each other as shown in FIG. 4. Therefore, the relation of regular intervals can be kept even when a length of the circumferential surface is extended by thermal expansion, and thereby registration accuracy for superposition of toner images can be maintained, and image quality of images can be ensured accordingly despite changes of ambient temperatures.

Next, the manufacturing method of the image forming body for the image forming apparatus in the present invention is explained. Firstly, the concrete manufacturing method of the high-sufficiency cylindrical substrate for an image forming body is explained with FIG. 6(*a*) as it is an important characteristic of the present invention.

Figure 6:
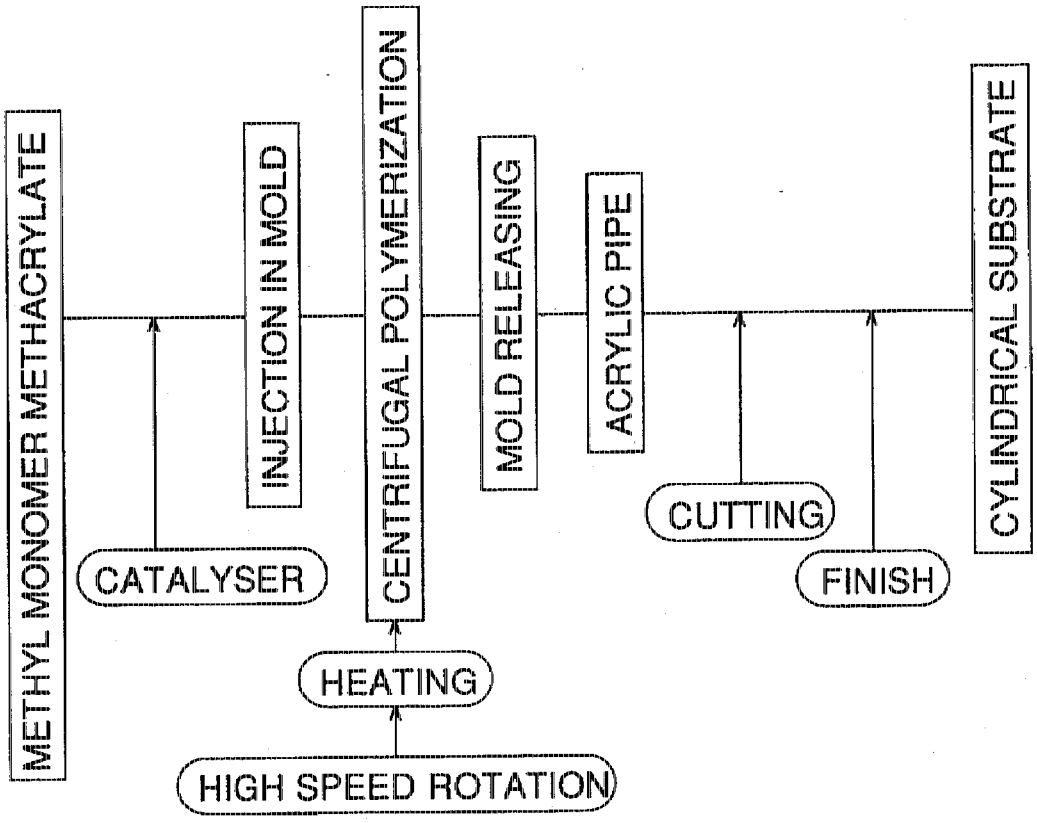
FIG. 6(*a*) is a block diagram of a manufacturing processes for a cylindrical substrate of the invention used in an image forming apparatus.
Figure 6:
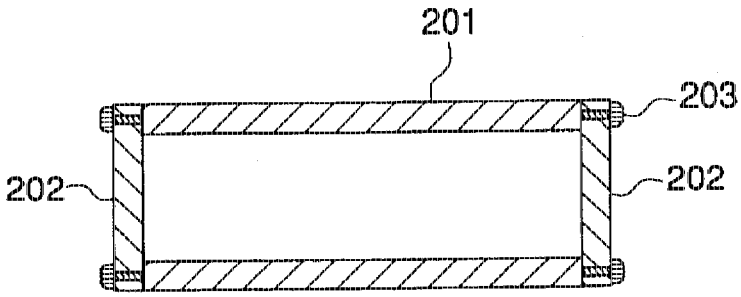

In the manufacturing process shown in FIG. 6(*a*), methylmethacrylate monomer is synthesized first, then it receives a catalyzer for its quick polymerization, and is poured into a cylindrical mold. After that, it is rotated together with a mold, and appropriate heat is given thereto for accelerating uniform polymerization. After completion of the polymerization, it is cooled, and a substrate thus obtained is taken out of the mold, and is cut, and is subjected to finishing process when necessary, to be finished as a cylindrical substrate used in an image forming body. FIG. 6(*b*) shows a sectional view of an example of a mold which is of a simple structure wherein a monomer liquid is poured in cylindrical mold 1 which is covered by lids 2. Incidentally, 3 represents bolts and nuts which connect the cylindrical mold to the lids.

The manufacturing method of the invention makes it possible to obtain a cylindrical substrate having hardness equal to that of aluminum, transmissibility of 90% or more and shock resistance which is 15 times that of glass.

Compared with those made by an extrusion method which is a molding method used widely today, no marks of dies are left on the surface of the cylindrical substrate, especially, an inner surface is formed to be the natural surface obtained through centrifugal force and to be extremely smooth like a glass surface. Besides, strength is higher than that of a cylindrical substrate obtained through an extrusion method, and the substrate made by the manufacturing method of the invention is excellent in stabilized mechanical strength and in thermal deformation temperature. Further, it has less internal stress, which causes no uneven light refraction in the case of transmitting light. Therefore, when it is used as a cylindrical substrate for a static image forming body (photoreceptor), and even when it is applied on an image forming apparatus wherein an image exposure light source is installed inside the cylindrical substrate, neither image exposure distortion nor deterioration of image performance is caused.

Though explanation was made above using polymethyl methacrylate in FIG. 6, any of ehtylpolymethacrylate, butylpolymethacrylate, butylpolyacrylate, polystyrene, polyimide, polyester or vinylpolychloride or copolymers of them can be used provided that they are resins capable of being subjected to heating polymerization.

Next, the method, to processing a cylindrical substrate of the invention as a static image forming body, will be explained. The cylindrical substrate of the invention has a smooth surface, and when copolymer of methylester methacrylate is used in particular, transparency is extremely high and strength is also high. Therefore, it is suitable for an image forming apparatus employing a mechanism wherein an exposure unit is located inside a substrate drum to conduct exposure from the inside.

A typical one is an electrophotographic photoreceptor which is provided with a conductive layer and a photoconductive light-sensitive layer on the surface of a cylindrical substrate. For providing the conductive layer and the photoconductive light-sensitive layer, methods which have so far been used can be employed widely.

Namely, typical methods for forming a transparent conductive layer include a method wherein a metal or an oxide of a metal such as aluminum or ITO (indium tin oxide) is subjected to vapor-deposition or spattering, and a method wherein conductive resin which is a mixture of ITO, aluminum conductive fine particles and resin is used for forming a layer.

For forming a light-sensitive layer, an inorganic conductive layer may be formed through vapor-deposition or the like. However, it is preferable to form by coating an organic photoconductive layer, especially an organic photoreceptor layer of a separated-function type having therein charge-transport-material and charge-generation-material, and especially that of a type wherein the charge-transport-material and the charge-generation-material are laminated separately.

The charge generation layer if formed by, if necessary, dispersing a charge generation material (CGM) in a binder resin. As for the CGM, charge transporting complexes consisting of, for example, metallic or non-metallic phthalocyanine compounds such as bisazo compounds, trisazo compounds, etc.; aquarium compounds, azurenium compounds, perylene compounds, indigo compounds, quinacridone compounds, polyquinone-type compounds, cyanine dyes, xanthene dyes, poly-N-vinylcarbazoles and trinitrofluorenones, etc. can be mentioned. However, the scope of the present invention is not limited to these. Moreover, these compounds may be used either individually or two or more kinds in combination. In order for the objectives of the present invention to be achieved at the most enhanced level, as mentioned above, a kind of perylene compounds, imidazoleperylene compounds, metallic phthalocyanine compounds (TiOPc) are preferable.

As for binder resins which are applicable in the charge generation layer, for example, polystyrene resins, polyethylene resins, polypropylene resins, polyacryl resins, polymethacryl resin, polyvinyl chloride resins, polyvinyl acetate resins, polyvinyl butyral resins, polyepoxy resins, polyurethane resins, polyphenol resins, polyester resins, polyalkyd resins, polycarbonate resins, polysilicone resins, polymelamine resins, and copolymer resins containing two one more repeating unit, for example, vinyl chloride-vinyl acetate copolymer resins, vinyl chloride-vinyl acetate-maleic acid anhydride copolymer resin; polymeric organic semi-conductors such as poly-N-vinyl carbazoles, etc. can be mentioned, however, again, the scope of the present invention is hot limited to these. Among the above-mentioned compounds, as particularly preferable binder when an imidazoleperylene compound is used as CGM, polyvinyl butyral resins, and silicone resins, polyvinyl butyral reins and a mixture of these resins when a TiOPc is used, can be mentioned.

The charge transportation layer is constructed either singly with a charge transportation material (CTM) itself or with CTM together with a binder resin. As for the CTM, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, stiryl compounds, hydrazone compounds, pyrazoline derivatives, oxazolone derivatives, benzimnidazole derivatives, quinazoline derivatives, benzofurane derivatives, acrydine derivatives, phenadine derivatives, aminostilbene derivatives, triarylamine derivatives, phenylenediamine derivatives, stilbene derivatives, benzidine derivatives, polyvinyl carbazoles, poly-1-vinyl pyrene, poly-9-vinyl anthrathene, etc. can be mentioned, however the scope of the invention is not limited to these. Further, these compounds may be used either individually or two or more compounds in combination.

As a binder resin usable for a charge-transport layer, there are given polycarbonate resin, polyacrylate resin, polyester resin, polystyrene resin, styrene-acrylnitlyl copolymer, ester polyemthacrylate resin, and styrene-ester methacrylate copolymer, for example, to which, however, the invention is not limited.

For reducing fatigue deterioration caused by repeated usage, or for improving durability, it is possible to use in any layer of a photoreceptor the conventional antioxidant, UV absorbing agent, electron-accepting substance surface-reforming agent, plasticizer and environment-dependency reducing agent by adding an appropriate amount of them, when necessary.

For improving durability, it is also possible to provide a non-light-sensitive layer such as a protective lay, when necessary, in addition to a light-sensitive layer. The above-explained cylindrical substrate for an image forming body can be used as an intermediate transfer drum by effectively using its superior characteristics.

For using as a transfer drum of an image forming apparatus or a cylindrical substrate for an intermediate transfer drum, it is necessary to provide a conductive layer and dielectric substance layer on a substrate through coating or other methods. It is preferable that the dielectric layer is a layer of high resistance of $10^5$–$10^{12}$ Ω.cm. There is no limitation for them in particular, and those which have so far been developed such as silicone rubber or fluorine rubber can be used widely. For adjusting conductivity, there is mixed a conductive carbon.

With regard to a substrate, when it is used for a static image forming body, a transfer drum or an inter mediate transfer drum, it is possible to realize preferable physical characteristics by mixing a polymerizing liquid material respectively with a cross linking agent, a conductivity-donating agent or with a coloring age for usage. For example, heat-resistance, solvent-resistance and strength can be improved by adding cross linking agent, and prevention of electrostatic contamination of dust or the like and replacement of a conductive layer can be attained by the conductivity-donating agent. These are effective for a static image forming body, a transfer drum or an intermediate transfer drum each of which is subjected to external force, heat or coating of a solution on its substrate.

In a static image forming transfer drum and an intermediate transfer drum, it is also possible to make directly a two-layered substrate composed of a conductive layer and a dielectric layer by repeating polymerization twice while changing a mixture rate of conductivity-donating agent.

Figure 7:
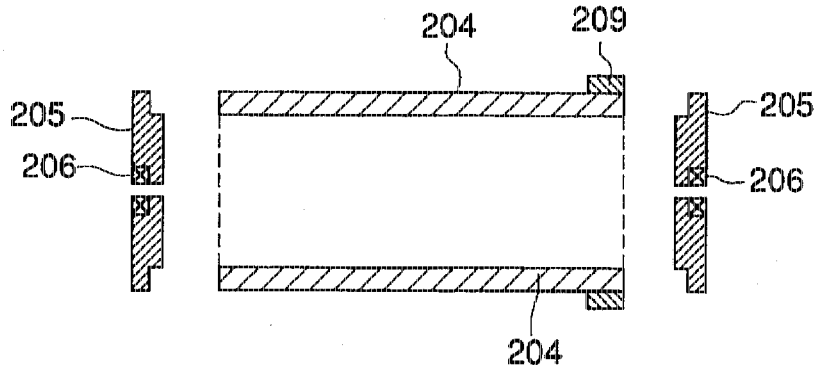
FIGS. 7(*a*) through 7(*d*) are sectional views of a cylindrical substrate in which a gear portion is united solidly as an embodiment of the invention.
Figure 7:
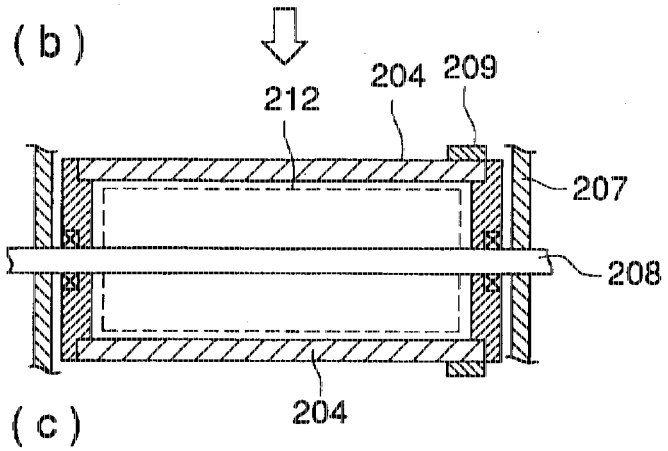
Figure 7:
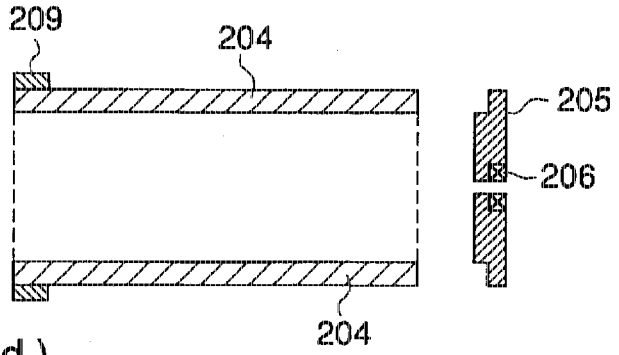
Figure 7:
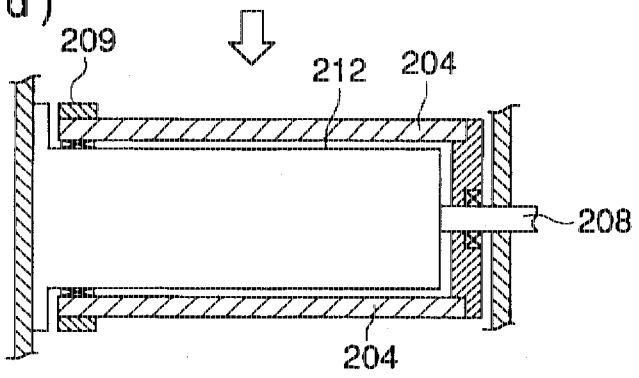

Further, when a member of driving gear portion 209 or the like is combined integrally with a mold die for cylindrical substrate 204 as shown in FIGS. 7 (*a*) and 7 (*b*), both of them can be made simultaneously when molding the substrate, resulting in no necessity of taking the trouble of attaching the aforesaid member. After coating an organic light-sensitive layer on the substrate, flange 205 was forced therein on a force fit basis, and then they were mounted in the apparatus through shaft 208, which is shown in FIG. 2 (*b*). In this case, 206 represents a bearing member and 207 represents a side wall plate of an enclosure frame of an image forming apparatus main body.

Incidentally, in this case, cylindrical substrate 204 shows a photoreceptor substrate having therein exposure optical system 212 shown in the example.

In FIG. 7 (*c*), flange 205 is provided only on the right-hand side of the cylindrical substrate, and driving gear 209 is provided solidly on the other side thereof. FIG. 7 (*d*) shows how the cylindrical substrate is mounted in the apparatus. In this structure, exposure optical system 212 is fixed on side wall plate 207 and cylindrical substrate 204 is supported on the exposure optical system 212.

The image forming apparatus, in which the above-explained intermediate transfer drum is used, is explained as example 2.

Figure 8:
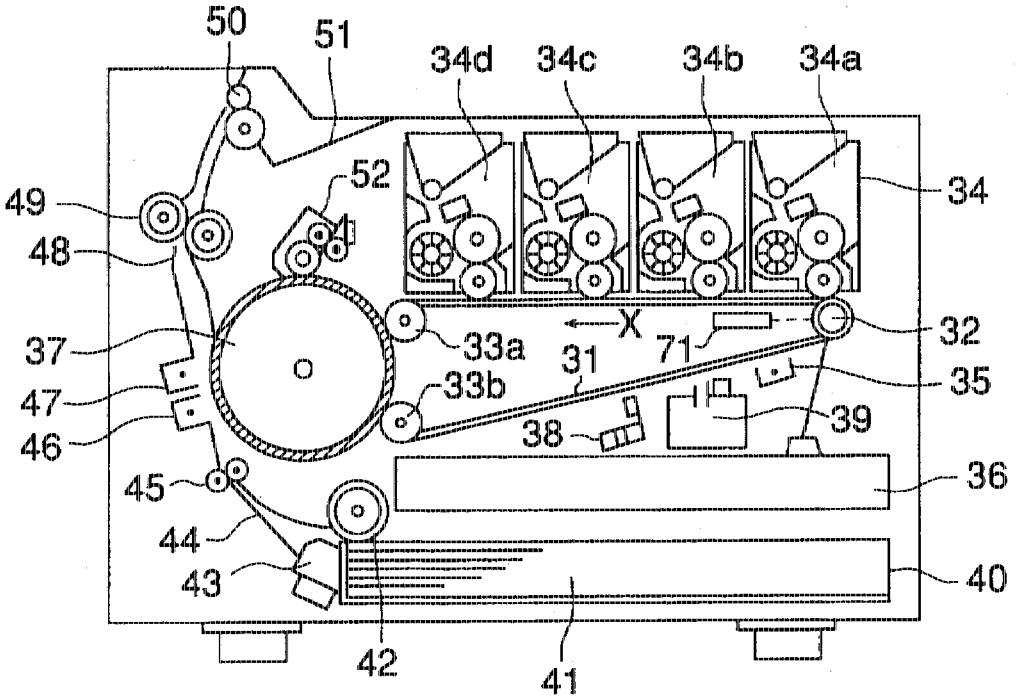
FIG. 8 is a sectional view of an image forming apparatus of the example 2 in the invention.

FIG. 8 is a longitudinal cross section of a color laser printer related to the invention. The color laser printer employs light-sensitive belt 31 as a photoreceptor forming toner images through an electrophotographic process. The light-sensitive belt 31 is formed by providing an organic photoconductive layer on the external surface of a conductive substrate that is obtained by coating or vapor-depositing a metal such as aluminum or the like on a substrate of polyester resin or the like. The light-sensitive belt 31 is wound around belt driving roller 32 that is located to be the vertex of a triangle of the belt and two driven rollers 33*a* and 33*b*, and is driven by the belt driving roller 32 to be rotated in the direction of arrow X. There are provided first developing unit 34*a*, second developing unit 34*b*, third developing unit 34*c* and developing unit 34*d* over and along the external surface of the light-sensitive belt 31. The first developing unit 34*a* forms a magnetic brush on a developing roll by using developing agents employing yellow (Y) toner, the second developing unit 34*b* forms a magnetic brush on a developing roll by using developing agents employing magenta (M) toner, the third developing unit 34c forms a magnetic brush on a developing roll by using developing agents employing cyan (C) toner, and the fourth developing unit 34d forms a magnetic brush on a developing roll by using developing agents employing black toner, and the developing units 34a, 34b, 34c and 34d can be controlled so that one of them is made to be on the state of operation selectively.

The light-sensitive belt 31 which is in the state of its rotation is charged uniformly by charging unit 35 and then is exposed to a laser beam emitted from laser beam exposure unit 38, thus, electrostatic latent images are formed thereon. The electrostatic latent image formed through exposure by means of a laser beam flashing-controlled in accordance with signals of an image to be recorded for forming a yellow (Y) toner image is developed by the first developing unit 34a to be converted into a yellow (Y) toner image. The electrostatic latent image formed through exposure by means of a laser beam flashing-controlled in accordance with signals of an image to be recorded for forming a magenta (M) toner image is developed by the second developing unit 34b to be converted into a magenta (M) toner image. The electrostatic latent image formed through exposure by means of a laser beam flashing-controlled in accordance with signals of an image to be recorded for forming a cyan (C) toner image is developed by the third developing unit 34c to be converted into a cyan (C) toner image. The electrostatic latent image formed through exposure by means of a laser beam flashing-controlled in accordance with signals of an image to be recorded for forming a black toner image is developed by the fourth developing unit 34d to be converted into a black toner image.

Intermediate transfer drum 37 manufactured by incorporating therein a cylindrical substrate of the invention is driven to rotate in the direction of arrow Y while being in contact with the light-sensitive belt 31 at the position between driven roller 33a and driven roller 33b. The intermediate transfer drum 37 is one wherein a resistor layer is formed on the outer surface of a dielectric substrate as a dielectric layer, and a first transfer portion where toner images are transferred from the light-sensitive belt 31 is structured at the aforesaid contact portion. For maintaining toner image transfer to be highly efficient and stable at the first transfer portion and for making intermediate transfer drum 37 to be driven to rotate stably, it is necessary to assure the contact width of 5 mm or more in the rotation direction at the contact portion, and the width of 10 mm or more can maintain the high transfer efficiency and high driving force more stably.

The light-sensitive belt 31 which has passed the first transfer portion is neutralized by erasing unit 38 and is cleaned by belt cleaning unit 39 to be free from remaining toner to be initialized. Then, it is used in electrophotographic process wherein it is charged uniformly again by charging unit 35 for formation of toner images for the following color.

A toner image of a different color to be formed successively is adjusted in terms of its position of formation because it is transferred to be superposed on the toner image which has already been transferred on the intermediate transfer drum 37. This position adjustment is conducted by controlling the electrostatic latent image formation timing.

In the full color image printing, yellow (Y) toner image formation, yellow toner image transfer, magenta (M) toner image formation, magenta toner image transfer, cyan (C) toner image formation, cyan toner image transfer, black (K) toner image formation, and black toner image transfer are conducted.

After multi-colored toner images are superposed on the surface of the intermediate transfer drum 37 (toner image of the last color is being formed on the light-sensitive belt 31 or it is being transferred from the light-sensitive belt 31 to the intermediate transfer drum 37), secondary recording medium 41 such as a recording sheet loaded on sheet-feed cassette 40 or an OHP sheet is extracted and separated by sheet-feed roller 42 and separation portion 44 and is transported to registration roller 45 through sheet transport path 44. The registration roller 45 adjusts conveyance timing for the secondary recording medium 41 so that toner images on the surface of the intermediate transfer drum 37 may be synchronized with the secondary recording medium 41 at the secondary transfer portion.

Being equipped with transfer unit 46 and neutralizing unit 47 both employing a corona discharging unit, the second transfer portion transfers toner images on the surface of the intermediate transfer drum 37 electrostatically onto the secondary recording medium 41. The transfer unit 41 gives to the back of the secondary recording medium 41 the D.C. corona electric charges which generate electrostatic force for transfer of toner images when the secondary recording medium 41 comes in contact with the intermediate transfer drum 37. The neutralizing unit 47 generates A.C. corona discharge which neutralizes electric charges on the secondary recording medium 41 for the purpose of reducing electrostatic adsorbability caused by the aforementioned electric charges when the secondary recording medium 41 on which toner images have been transferred is separated from the intermediate transfer drum 37. Separation claw 47 is provided for the purpose of separating the secondary recording medium 41 from the intermediate transfer drum 37 without fail.

Fixing unit 49 fixes toner images on the secondary recording medium 41, and ejection roller 50 ejects the secondary recording medium 41 on which toner images are fixed to copy tray 51.

Drum cleaning unit 52 that cleans the intermediate transfer drum 37 is provided so that it may either come into contact with or leave the intermediate transfer drum 37. The drum cleaning unit 52 is operated to be away from the intermediate transfer drum 37 in the course of transferring toner images of various colors to form a color toner image on the intermediate transfer drum 37, and is operated to come into contact with the intermediate transfer drum 37 and thereby to remove toner remaining on the surface of the intermediate transfer drum 37 after completion of the transfer step.

Figure 9:
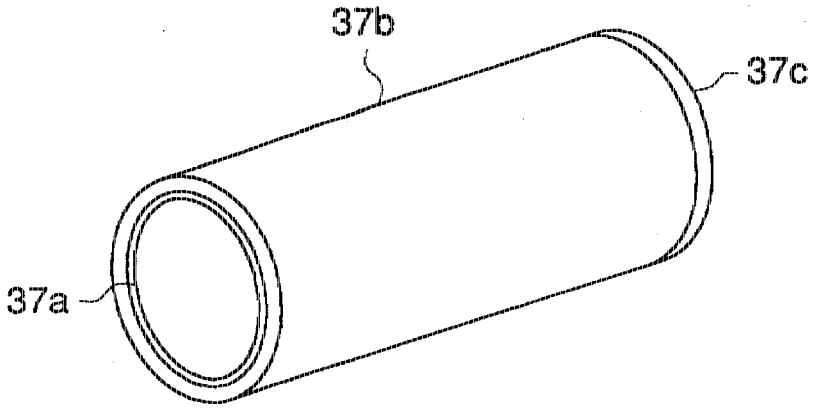
FIG. 9 is a perspective view of an intermediate transfer drum employing a cylindrical substrate of the invention.

Intermediate transfer drum 37 employing a cylindrical substrate of the invention is structured as shown in the perspective view in FIG. 9 wherein a conductive resin layer is coated on a cylindrical substrate of the invention and resistor layer 37b adjusted to a prescribed resistance value is formed as a dielectric layer on the surface of the conductive resin layer. Insulating layer 37c is provided on both ends or one end of the intermediate transfer drum 37 being located at a position that makes contact with a portion where bias voltage is given to light-sensitive belt 31. Drum substrate 37a of the intermediate transfer drum 37 is connected to earth voltage. The resistor layer 37b is made of urethane or fluorine resin whose resistance value is adjusted by dispersing therein conductive metallic powder such as, for example, carbon black or aluminum. It is preferable that the resistance value of the resistor layer 37b is about $10^6$–$10^{12}$ Ω.cm. When the resistance value is high, the surface of the intermediate transfer drum 37 is excessively charged to be charge-up undesirably, and thereby driven-driving force utilizing electrostatic adsorption force caused by bias voltage impressed on light-sensitive belt 31 is lowered. For preventing this charge-up, the resistance value of the resistor layer 37*b* had to be not more than $10^{12}$ Ω.cm, according to the experiments made by the inventors. However, when the resistance value of the resistor layer 37*b* is too low, sufficient transfer electric field can not be obtained when transferring color toner images formed on the intermediate transfer drum 37 onto secondary recording medium 51, resulting in lowered transfer efficiency. The lower limit thereof was about $10^6$ Ω.cm. As a resistance value of the resistor layer 17*b*, therefore, a range of $10^6$–$10^{12}$ Ω.cm is preferable.

Light-sensitive belt 31 is structured in a way wherein belt substrate 31*a* is made of resin such as polyester or the like, and its surface is coated or vapor-deposited with a metal such as aluminum or the like to form conductive layer 31*b*, and organic photoconductive layer 31*c* is formed on the conductive layer 31*b*. On each of both ends or on one end of the light-sensitive belt 31, there is provided voltage-supplying portion 31*d* for supplying bias voltage to the conductive layer 31*b*. The light-sensitive belt 31 is mounted to be isolated electrically from the surrounding, and is subjected to impression of bias voltage which makes the voltage of the light-sensitive belt 31 to be negative voltage against earth voltage when brush 73 connected to bias supply 72 is subjected to sliding contact with the voltage-supplying portion 31*d*. For securing driving force of not less than 1 kg.f and toner image transfer efficiency of not less than 80%, bias voltage to be impressed on the light-sensitive belt 31 needs to be established within a range between −200 and −1400 V, and a range of −400—800 V is preferable.

In a first transfer portion where both the light-sensitive belt 31 and the intermediate transfer drum 37 rotate while they are in contact with each other, the light-sensitive belt 31 is biased by a bias supply to −600 V , for example. Therefore, there is generated an electrostatic adsorption force between the light-sensitive belt 31 and the intermediate transfer drum 37 connected to earth voltage. When a bias voltage is not impressed, a force with which the light-sensitive belt 3 pressed by driven rollers 33*a* and 33*b* drives the intermediate transfer drum 37 is 100–200 g.f which causes a slip between them, but when a bias voltage is impressed, an electrostatic adsorption force generated between them makes the driving force to be 1 kg.f or more which makes the light-sensitive belt 3 and the intermediate transfer drum 37 to be driven at the same speed without generating a slip between them. An electric field generated by a bias voltage supports toner images having a negative polarity to be transferred from the light-sensitive belt 3 to the intermediate transfer drum 37. By repeating the transfer for composition so that toner images formed on the light-sensitive belt 31 each having different color are superposed while the intermediate transfer drum 37 repeats its rotation, a color toner image can be completed.

In printing of a color image on the color laser printer, no doubling was observed and it was possible to conduct excellent transfer of toner image images, and color images with high image quality were obtained. Incidentally, when a cylindrical substrate of the invention is used for a transfer drum, image forming can be performed through the process that is mostly the same as that in the foregoing, except that a transfer sheet is wound around a drum and no transfer is carried out on the second recording medium. It was found that a cylindrical substrate of the invention showed excellent characteristics even in this case.

Due to the invention, problems of strain and deformation of a photoreceptor drum caused by pressure contact of plural developing units and cleaning units are solved, thereby, highly accurate superposition of plural toner images conducted during one turn of a photoreceptor drum can be realized, and it has become possible to make a photoreceptor drum small by using a space occupied by plural exposure optical systems effectively, resulting in attainment of a color image forming apparatus which is small-sized but is capable of forming images with high image quality at high speed and is extremely useful practically.

Further due to the invention, it was possible to develop a manufacturing method for an image forming body to be used for a static image forming object which can be manufactured efficiently on an industrial basis and has high surface accuracy and high overall strength, while being transparent sufficiently when necessary. In addition, when the cylindrical substrate used as an image forming body mentioned above is used for an image transfer body or for a substrate of an intermediate transfer drum, it is possible to manufacture an image forming apparatus having excellent characteristics.

What is claimed is:

1. An image forming apparatus for forming a color image, comprising:

an image forming body, being rotatable and having a drum-shaped body and a circumferential surface, for retaining a color toner image;

wherein said image forming body includes:

a transparent substrate having a wall-thickness between 2.5 mm and 8 mm and an inner diameter between 60 mm and 200 mm; and a light-sensitive layer;

a plurality of charging means, provided on a periphery of said image forming body, for charging said image forming body;

a plurality of imagewise exposure means, provided inside of said image forming body, for forming a latent image on said circumferential surface; and a plurality of developing means, provided on a periphery of said image forming body, for developing said latent image with a color toner so as to form a color toner image on said circumferential surface.

2. The image forming apparatus of claim 1, wherein said color toner image is formed on said circumferential surface for a plurality of times while said image forming body is being rotated one time.

3. The image forming apparatus of claim 1, wherein said transparent substrate is made of resins.

4. The image forming apparatus of claim 3, wherein at least one of a flange portion and a gear portion is uniformly formed on an end of with said transparent substrate.

5. The image forming apparatus of claim 1, wherein said image forming body is surrounded with said plurality of said developing means, and said each developing means is in pressure contact with an outer surface of said image forming body.

6. The image forming apparatus of claim 1, further comprising:

a supporting means for commonly supporting said image forming body and said plurality of imagewise exposure means.

7. The image forming apparatus of claim 6, wherein said plurality of imagewise exposure means are located in a periphery of said image forming body at same interval distances.

8. The image forming apparatus of claim 1, wherein said transparent substrate is made of a resin which is polymerized in the steps of:

pouring a polymerizing liquid material in a cylindrical mold; and rotating and heating said polymerizing liquid material in said cylindrical mold.

9. The image forming apparatus of claim 8, wherein said polymerizing liquid is rotated and heated in a presence of a catalyzer.

10. The image forming apparatus of claim 8, wherein said polymerizing liquid material includes at least one of a crosslinking agent, a conductivity-donating agent, and a coloring agent.

11. The image forming apparatus of claim 8, wherein said transparent substrate is coated to form an organic photoconductive layer on said transparent substrate.

12. The image forming apparatus of claim 1, wherein said transparent substrate is made of optical glasses.

* * * * *